US006772598B1

(12) United States Patent
Rinehart

(10) Patent No.: US 6,772,598 B1
(45) Date of Patent: Aug. 10, 2004

(54) REFRIGERANT LEAK DETECTION SYSTEM

(75) Inventor: Charlie M. Rinehart, Lawton, OK (US)

(73) Assignee: R.S. Services, Inc., Duncan, OK (US)

( * ) Notice: Subject to any disclaimer, the term of this patent is extended or adjusted under 35 U.S.C. 154(b) by 0 days.

(21) Appl. No.: 10/427,456

(22) Filed: May 1, 2003

Related U.S. Application Data

(60) Provisional application No. 60/381,394, filed on May 16, 2002.

(51) Int. Cl.[7] ..... F25B 49/02

(52) U.S. Cl. ..... 62/126; 62/129; 340/632

(58) Field of Search ..... 62/125, 126, 127, 62/129, 130, 149, 174; 340/632, 633, 634

(56) References Cited

U.S. PATENT DOCUMENTS 4,138,856 A * 2/1979 Orlowski ..... 62/181
4,644,755 A * 2/1987 Esslinger et al. ..... 62/126
4,711,096 A * 12/1987 Krantz ..... 62/129
4,890,459 A * 1/1990 Havemann ..... 62/126
4,958,503 A 9/1990 Thompson
5,351,037 A 9/1994 Martell
5,419,177 A 5/1995 Pastorello
H1676 H 9/1997 Marshall
5,846,833 A 12/1998 Clough
D458,854 S 6/2002 Hughes

* cited by examiner

*Primary Examiner*—Harry B. Tanner
(74) *Attorney, Agent, or Firm*—Randal D. Homburg

(57) ABSTRACT

A leak detection system for the detection and monitoring of pressurized refrigerant systems, primarily walk-in refrigeration units in stores or storage facilities, manages, monitors and controls the refrigeration system which store and preserve perishables. The system includes a gas refrigerant detector and a monitor and relay system to alert the store personnel and remote monitoring stations that a problem exists by detecting the presence of gas outside the system within the refrigeration units, assessing the magnitude of the problem, and providing an emergency shutoff means to close and contain the refrigeration system contents in the event a substantial refrigeration leak is detected, closing the system until system repairs are made and the system is reset.

11 Claims, 10 Drawing Sheets

54
54
52
52
164
42
10
12
10
12
172
172
166
6
6
8
174
168
4
4
176
170
178
400
400

REFRIGERANT LEAK DETECTION SYSTEM

CROSS REFERENCE TO RELATED APPLICATIONS

Applicant claims the benefit of a Provisional Patent Application, Serial No. 60/381/394, filed on May 16, 2002.

I. BACKGROUND OF THE INVENTION

1. Field of Invention

The leak detection system for the detection and monitoring of pressurized refrigerant systems, primarily walk-in refrigeration units in stores or storage facilities, monitors and controls the refrigeration system which store and preserve perishables. The system includes a gas refrigerant detector and a monitor and relay system to alert the store personnel and remote monitoring stations that a problem exists by detecting the presence of gas outside the system within the refrigeration units, assessing the magnitude of the problem, and providing an emergency shutoff means to close and contain the refrigeration system contents in the event a substantial refrigeration leak is detected, closing the system until system repairs are made and the system is manually reset.

2. Description of Prior Art

In the industry, there are numerous monitoring systems which detect a variety of chemicals and environmental contaminants, as well as environmental conditions. Different sensors are presented to detect gas, vapor airborne particles or liquids. However, no specific detection systems to monitor air quality in refrigeration units or detect refrigeration leakage has been presented until the disclosure of this invention, which is adapted to monitor one or more refrigeration units per site and convey information to site personnel as well as a remote monitoring location.

The following United States patents were discovered and are disclosed within this application for utility patent. Three simple gas detection devices are identified in U.S. Pat. No. 4,958,503 to Thompson, which uses a liquid reservoir to sense gas bubbles, U.S. Pat. No. 5,846,833 to Clough, to withdraw gas from a closed system to test non-hydrocarbon refrigerants for the presence of hydrocarbons through pressure measurement, and U.S. Pat. No. 5,419,177 to Pastorello, to measure the presence of contaminants in a refrigerated gas under pressure.

In a U.S. Statutory Invention Registration No. H1676 to Marshall, a system for the monitoring of combustible liquid gas in service stations is disclosed which monitors fuel spillage and area and environment contamination using non-mechanical fluid sensors in communication with a central processor, which also may involve the use of fail safe self diagnostic devices, differentiating sensors, specifically Hall Effect sensors. The system distinguishes the source, nature and severity of a leak or spill of fuel and other fluids, provides a local or remote signal and compiles historical and analytical data relevant to the recorded events, integrating these functions with other function of recording of service station operations.

U.S. Pat. No. 5,351,037 to Martell, discloses a refrigerant gas leak detector that operates using a high voltage current across a pair of electrodes so that a corona current is generated through the electrodes, and also contains a gas sensor circuit that detects changes in the concentration of the refrigerated gas present in the vicinity of the sensing tip based upon the magnitude of voltage across the tip. This patent discloses the method for using the device and also the device which includes a sensing tip having a pair of electrodes, a generating means for the production of the voltage across the electrodes, a controlling means on the generating means, and a detection means coupled to one of the electrodes for detecting the change in the refrigerated gas concentration. There is also a signal differentiating aspect in the invention with a comparative first base signal and a second instantaneous signal, which could be applied to an alert means as to differential measurement of gas levels.

However, none of the above devices, either alone or in combination, provide the elements or function of the current system, nor do they combine to serve the stated use or function of the gas leak detection system.

II. SUMMARY OF THE INVENTION

In many large stores and storage facilities, there are often several walk-in refrigerated units containing perishable items, which contain multiple refrigeration closed pressure systems. Monitoring these systems requires technology to sense the presence of refrigerated gas leaks in the system prior to a major problem, which could result in complete loss of all refrigerated gas within the system, damage to the refrigeration system by continued operation without pressure, gas or gas lubricant, and also the loss of the contents within the refrigeration unit, including food, medicine and other products and supplies requiring refrigeration, as well as danger to personnel inside the confined space of the walk-in refrigeration unit. In many instances, there is not sufficient alternative storage facilities in the vicinity, and those stored items are simply lost during system failure. This loss of product, loss of refrigerant without system shutdown, and damage to the system is not only expensive, but it could also be detrimental to personnel and the environment.

The current gas leak detection system provides a graduated monitoring system that senses different set levels of refrigerated gas within the walk-in refrigeration unit, relays signals and warning of such leak detection and automatically causes system shutdown and capture of remaining refrigerated gas within the system, preventing damage to the system, minimizing loss of refrigerated gas and also alerting local and remote monitoring station of system problems so that immediate arrangements for repair, evacuation of personnel and preservation of contents can be instituted to minimize loss of product.

The primary objective of the gas leak detection system are to provide a local and remote monitoring system in walk-in refrigeration units to monitor and detect refrigerant leaks, relay information as to status and leak detection in the air within one or more walk-in refrigeration unit. A second objective of the invention is to provide a system which, after having sensed a quantity of refrigerant in the walk-in refrigeration unit, causes the system to shut down and retain the remaining gas refrigerant within the system. A third objective is to provide a several stage warning system to alert the store monitoring personnel of a system failure with sufficient time to evacuate the personnel and correct the problem before a major system failure occurs.

III. DESCRIPTION OF THE DRAWINGS

The following drawings are submitted with this utility patent application.

Figures 5A, 5B:
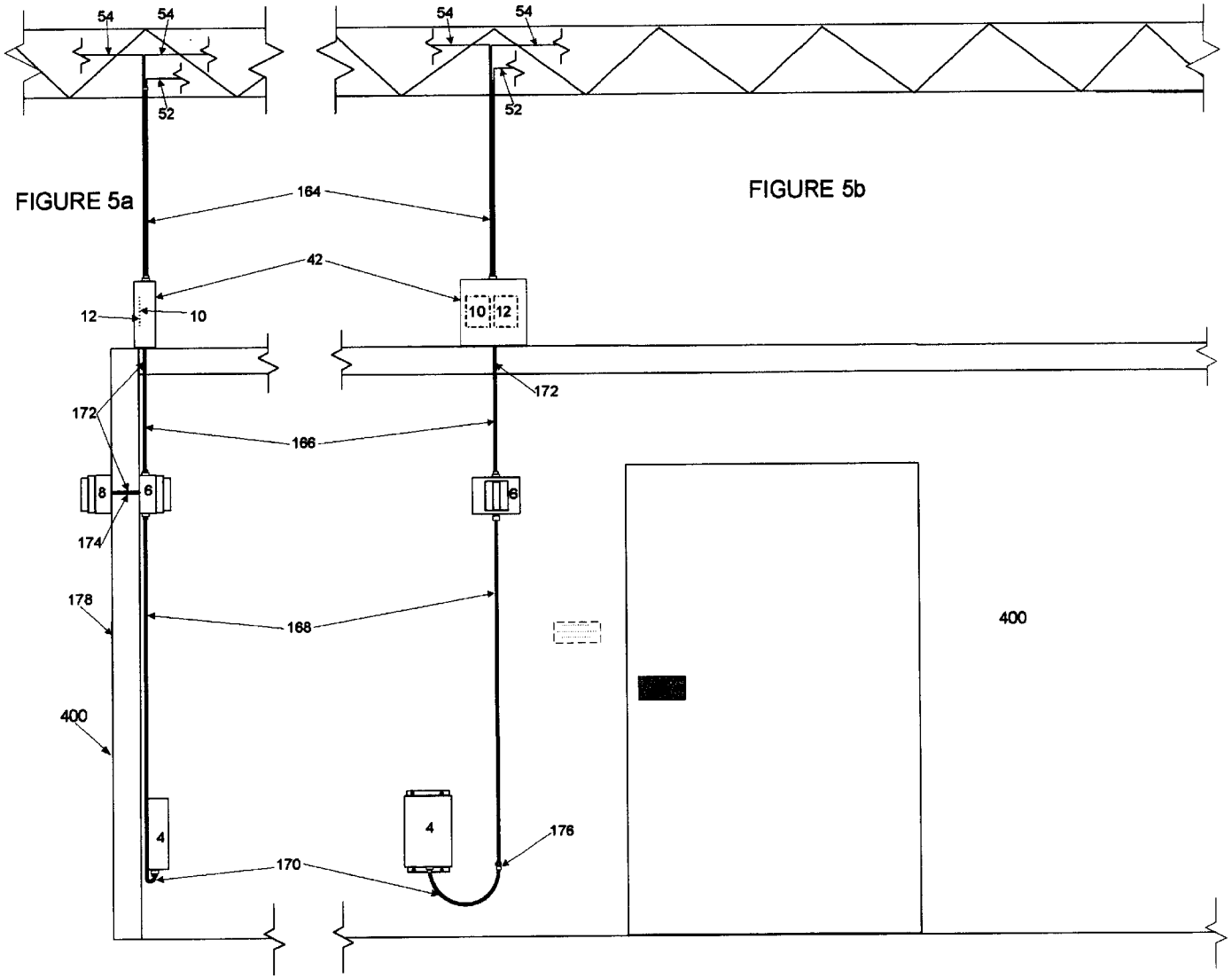

FIGS. 5*a* and 5*b* are a first embodiment of a walk-in horn strobe sensor mounting.

Figures 6A, 6B:
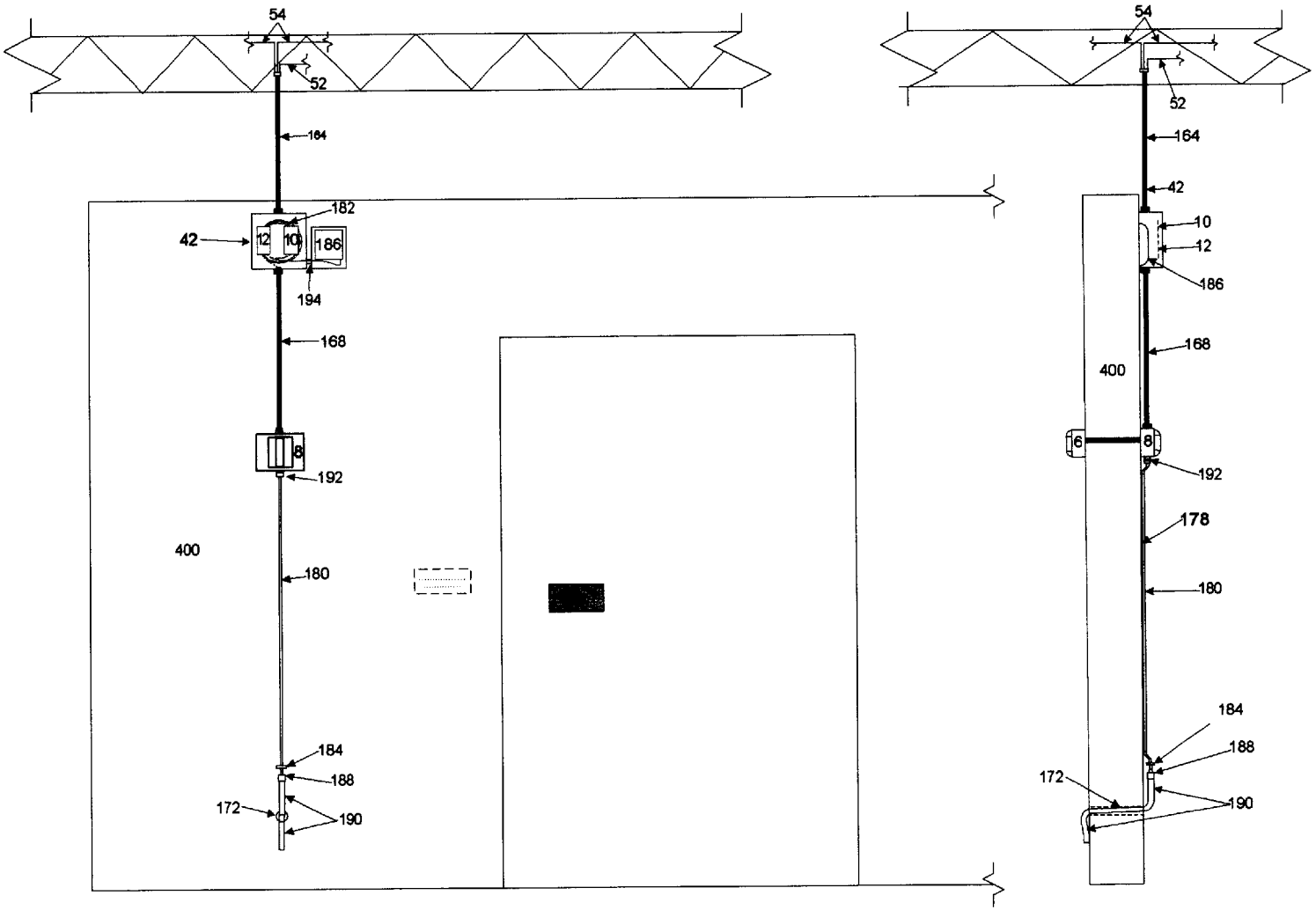

FIGS. 6*a* and 6*b* are a second embodiment of a walk-in horn strobe sensor mounting.

Figure 7B:
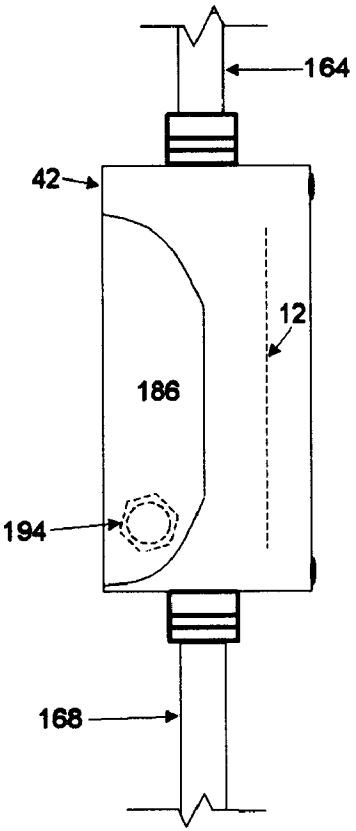
Figure 7A:
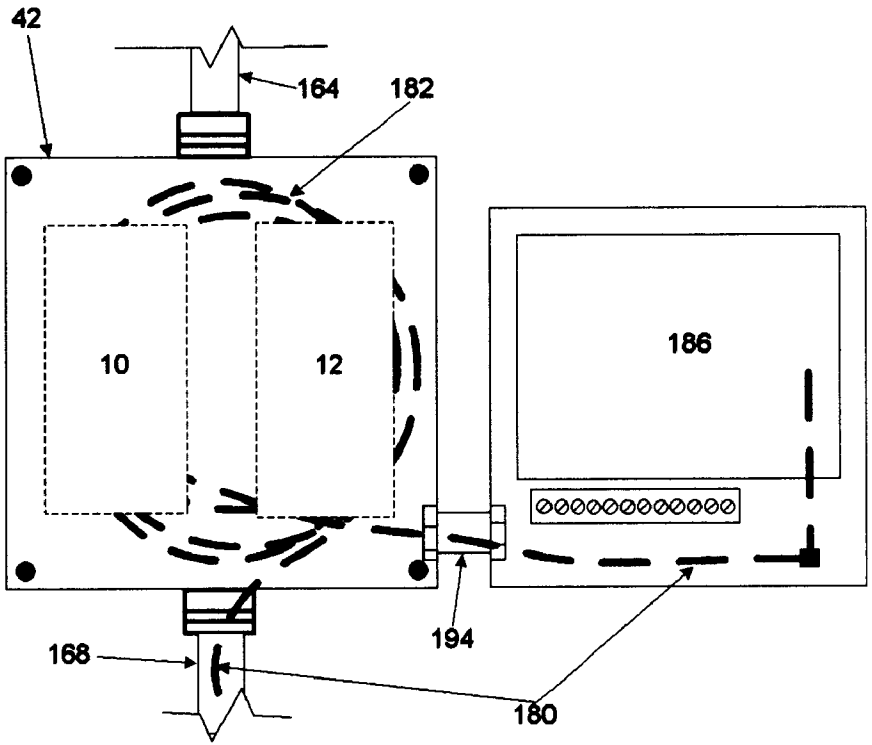

FIGS. 7*a* and 7*b* are detail drawings of the junction box for sensor mounting.

Figure 8:
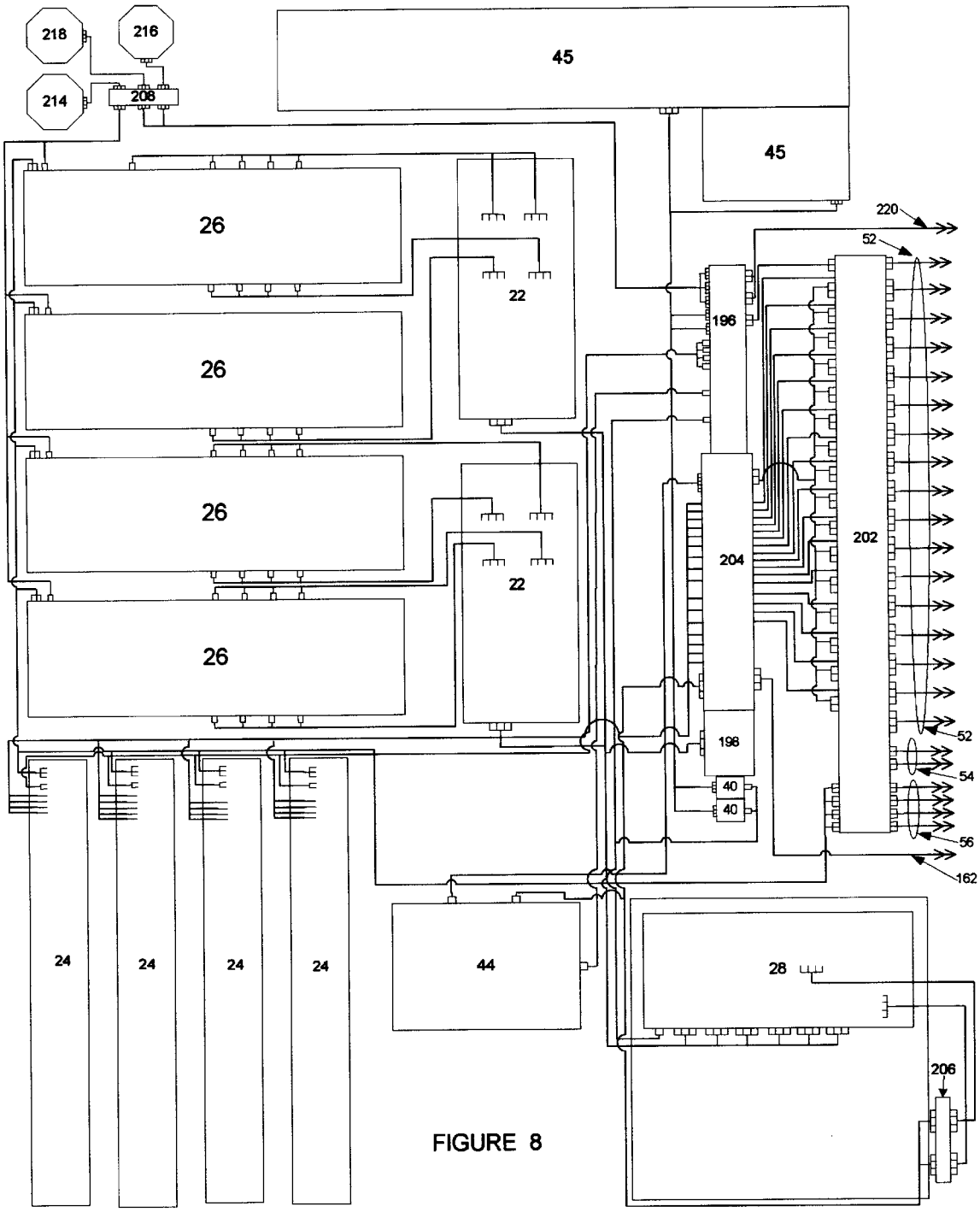

FIG. 8 is a large component major component and terminal strip layout.

Figure 9:
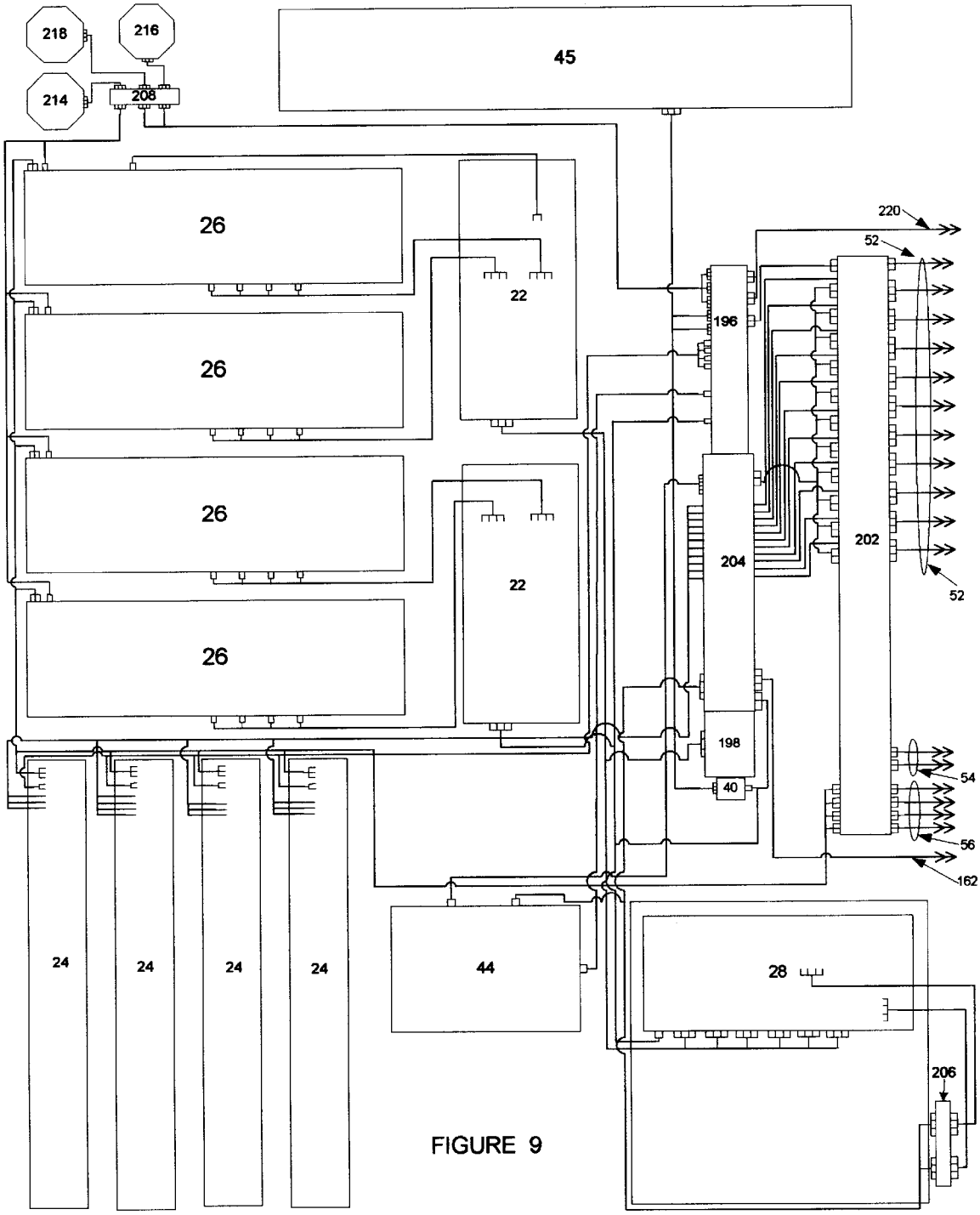

FIG. 9 is a small control panel major component and terminal strip layout.

Figure 10:
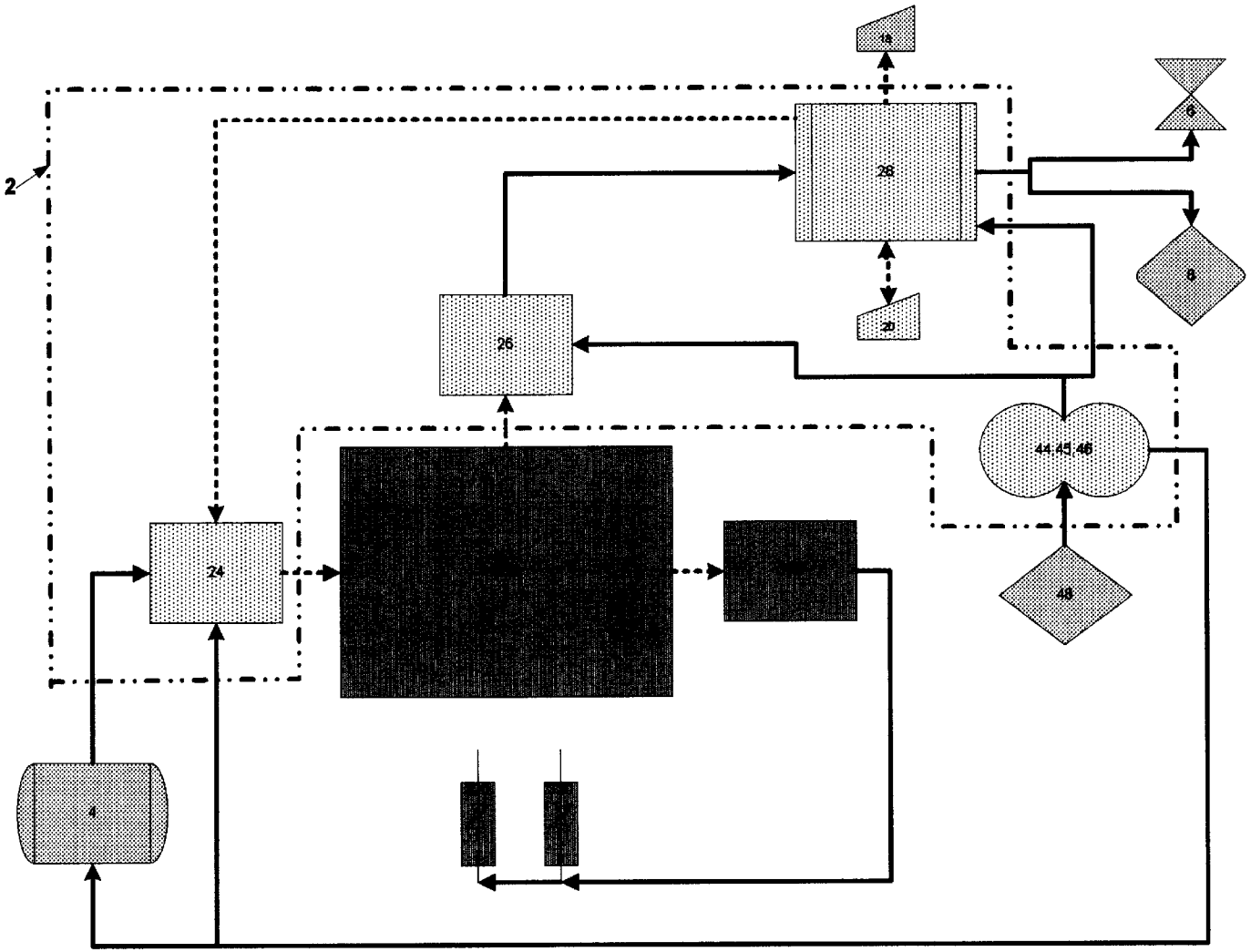

FIG. 10 is an operational flow chart of the system.

IV. DESCRIPTION OF THE PREFERRED EMBODIMENT

A leak detection system for monitoring walk-in coolers and freezers for refrigerant leaks while initiating audio and visual alarms for the affected areas where a leak is provided in compliance and conformity with UMC 1120 ASHRE 15, N.F.P.A. 70 and N.F.P.A. 72. The leak detection system, using the technology and summary of components as disclosed in FIGS. 1–10, is compatible with multiple main refrigeration control systems and refrigeration leak sensors, and can control stand alone refrigeration units not controlled by a main refrigeration control system, initiating independent audio and visual alarms and alerts. All circuits are supervised and power sources are monitored with back-up power units supplied internally and externally. The system can be controlled and reset on site or from a remote location. The system contains panel mounted and remote keypad control mechanisms, and the system status, trouble and alarms can be monitored through the main refrigeration control system and most fire alarm monitoring stations. An event log is included within the system, and the remote control troubleshooting can be relayed off premises by telephone or other wire communication means. Tamper proof prevents are also included in the leak detection system.

The leak detection system, shown in FIG. 10 of the drawings, comprises essentially a refrigerant leak detection control panel 2, at least one remote refrigerant leak sensor 4 within a walk-in refrigeration unit 400 connecting to the control panel 2, an uninterruptable power supply 48 connected to and providing power to the control panel 2, at least one inside walk-in horn and strobe unit 6, having a horn and a strobe, connected to the control panel 2 through an addressable horn control module 10, at least one outside walk-in horn and strobe unit 8, having a horn and a strobe connected to the control panel through an addressable strobe control module 12, a horn and strobe power supply with battery backup 46 connected to the at least one inside walk-in horn and strobe unit 6 and the at least one outside walk-in horn and strobe unit 8, an addressable fire alarm control panel (FACP) 28 within the control panel connecting to a power supply with battery backup 44, the control panel further connected to the refrigeration compressor equipment room 38 by a data power cable 162 first through a zone expansion module 30 and further to an addressable relay module 14, integrating with a refrigeration compressor controller 300 of the walk-in refrigeration unit 400, to an output module 320 of the walk-in refrigeration unit 400, and further to evaporator liquid and suction line solenoid valves 310 controlling the flow of refrigerated gas to the walk-in refrigeration unit 400 in the event a shutdown is warranted.

Figure 1:
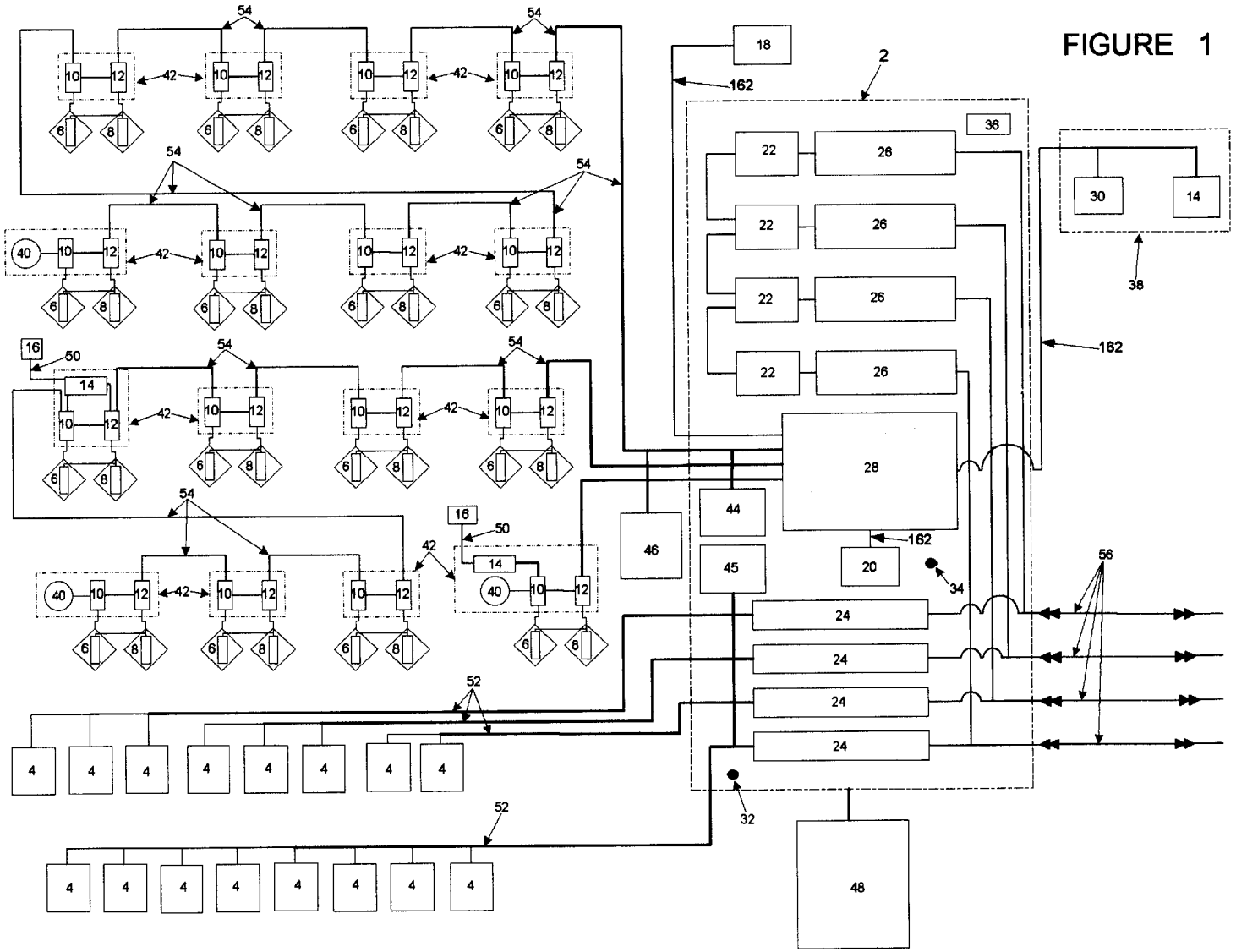
FIG. 1 is a diagram of a large system configuration.
Figure 2:
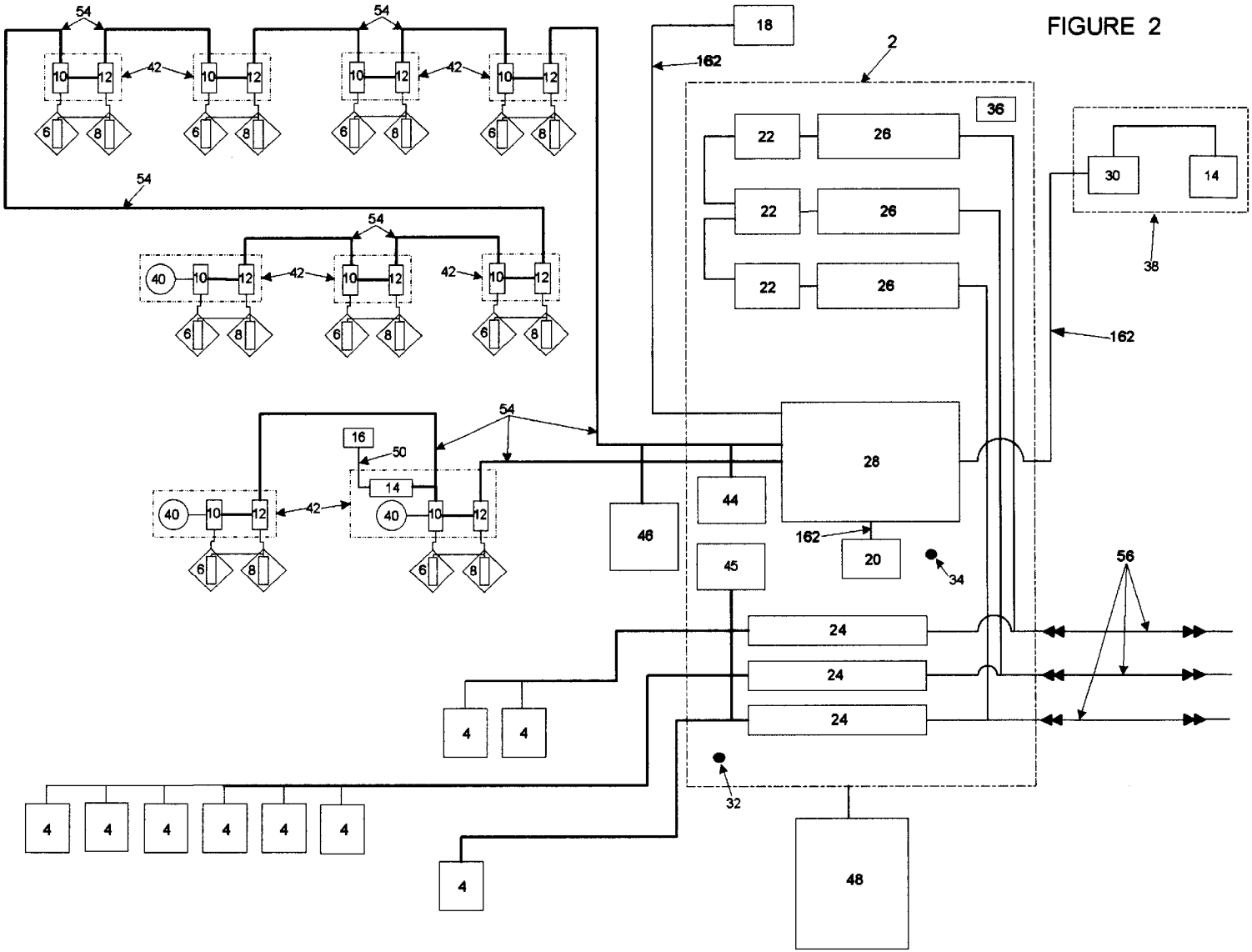
FIG. 2 is a diagram of a small system configuration.

The control panel 2, shown in FIGS. 1 and 2 of the drawings in a large and small embodiment, further comprises the FACP 28 to which is connected by a the data power cable 162 to a first FACP keypad 20 located in the front of the control panel 2, and to a second remote FACP keypad 18 located remotely where the building and fire security instruments are placed, at least one FACP zone expansion module 22 connected to at least one output module 26 further connected to at least one input module 24 through the refrigeration compressor controller 300 and ultimately to at least one refrigerant leak sensor 4, a tamper strobe 36 activate by unauthorized access to the control panel, a system reset switch 34 to reset the control panel after response and a power indicator 32 indicating power to the control panel 2. An addressable module power supply with battery backup 44 is located within the control panel 2, which is attached in line with the at least one addressable horn and strobe control modules 10, 12, while a horn and strobe power supply with battery backup 46 is attached to the inside and outside horn and strobe units 6, 8, although the horn and strobe power supply with battery backup 46 may be located outside the control panel. A sensor and system power supply 45 is also located within the control panel 2, supplying the power supply to the at least one refrigerant leak sensor 4. A plurality of input and output module communications cables 56 may extend from the control panel 2 for remote monitoring of the leak detection system.

Figure 3:
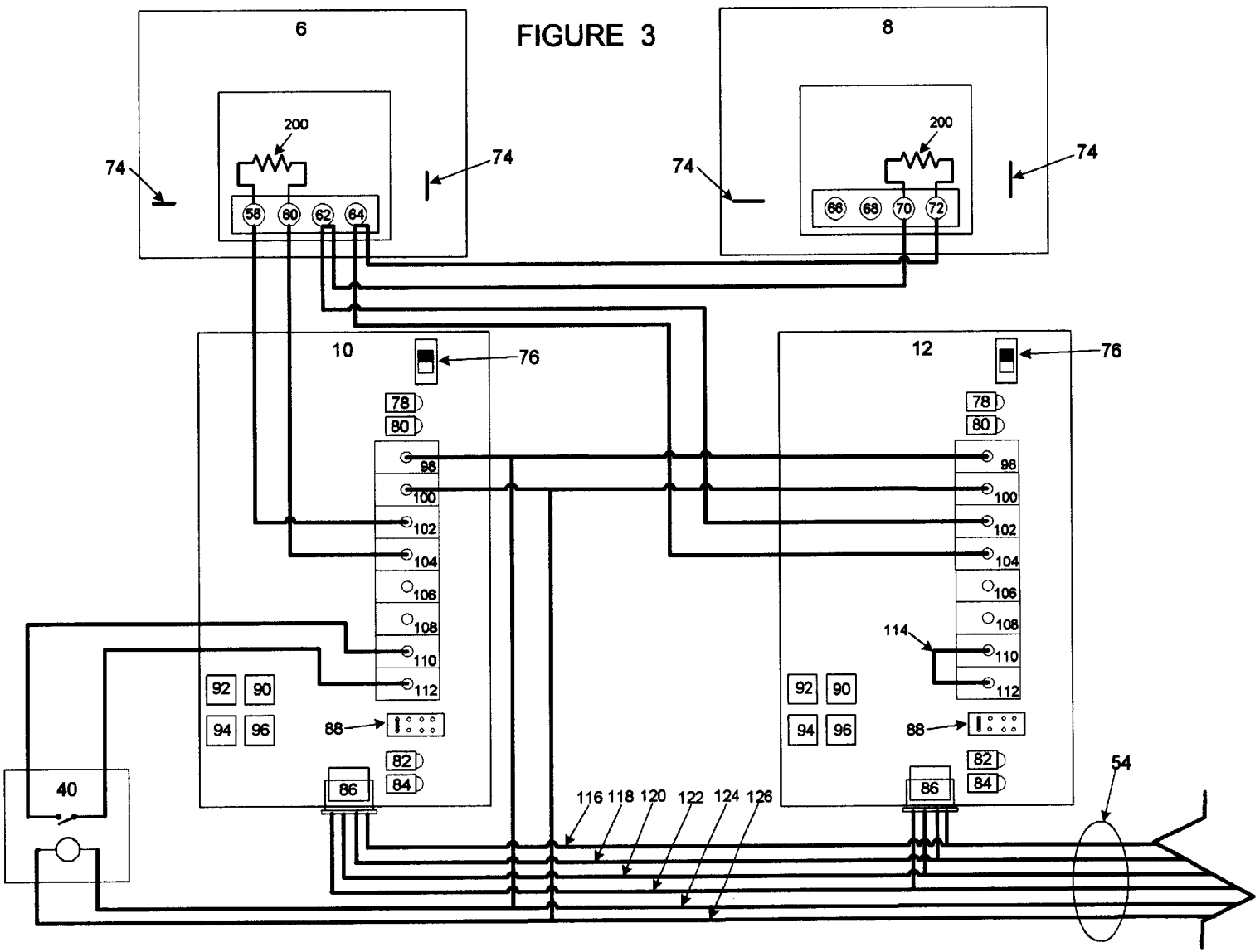
FIG. 3 is a drawing of the walk-in Notification Appliance Circuit configuration.

The inside and outside walk-in horn and strobe units 6,8 and the addressable horn and strobe control modules 10, 12, further comprise the elements as shown in FIG. 3. Each inside walk-in horn and strobe unit 6 comprises two horn-strobe mode jumpers 74, a 1K ½ W end of line resistor between a positive inside horn terminal 58 and negative inside horn terminal 60, and a positive inside strobe terminal 62, and a negative inside strobe terminal 64. Each outside walk-in horn and strobe unit 8 comprises two horn-strobe mode jumpers 74, a 1 k ½ W end of line resistor between a positive outside strobe terminal 70 and a negative outside strobe terminal 72, and a positive outside horn terminal 66 and a negative outside horn terminal 68. The inside and outside walk-in horn and strobe units 6, 8 are then wired into the addressable horn and strobe control modules 10, 12, as indicated in FIGS. 3.

In FIG. 3, the addressable horn control module 10, further comprises an N.A.C. normal silence switch 76, a bell trouble LED 78 a ground fault LED 80, a power supply monitor LED 82, a data LED 84, a module data and 12 V DC power connector 86, a bell ring style selector jumper 88, a first bell relay address switch (ones) 90, a second bell relay address switch (tens) 92, a first supervisory circuit address switch (ones) 94, a second supervisory circuit address switch (tens) 96, and a terminal connector strip providing a bell power in-positive terminal 98, a bell power in-negative terminal 100, a bell power out-positive terminal 102, a bell power out-negative terminal 104, a first bell trouble relay terminal 106, a second bell trouble relay terminal 108, a power monitor terminal 110, and a power monitor return terminal 112, the power monitor terminal 110 and the power monitor return terminal 112 connecting to the end of line power monitor relay 40.

The addressable strobe control module 12 is internally identical to the addressable horn control module 10 with the exception of the wiring connections as indicated in FIG. 3. The addressable strobe control module also has an N.A.C. normal silence switch 76, a bell trouble LED 78 a ground fault LED 80, a power supply monitor LED 82, a data LED 84, a data monitor 12 V DC power connector 86, a bell ring style selector jumper 88, a first bell relay address switch (ones) 90, a second bell relay address switch (tens) 92, a first supervisory circuit address switch (ones) 94, a second supervisory circuit address switch (tens) 96, and a terminal connector strip providing a bell power in-positive terminal 98, a bell power in-negative terminal 100, a bell power out-positive terminal 102, a bell power out-negative terminal 104, a first bell trouble relay terminal 106, a second bell trouble relay terminal 108, a power monitor terminal 110, and a power monitor return terminal 112 , except there is no connection to the end of line power monitor relay 40, but instead a power monitor jumper 114 between the power monitor terminal 110 and the power monitor return terminal 112. Attaching to the module data and 12 V DC power connector 86 of each addressable horn control module 10 and each addressable strobe control module 12 is a data power cable, which relays information to and from the control panel 2. This data power cable 54 should be one at least having a red module 12 V DC positive power wire 116, a yellow module data wire 118, a green module data wire 120, a black module 12 V DC negative power wire 122, an orange horn and strobe 24 V DC positive power wire 124, and a brown horn and strobe 24 V DC negative power wire 126, most generally and collectively an 18/6 type VNTC tray cable 54.

Figure 4:
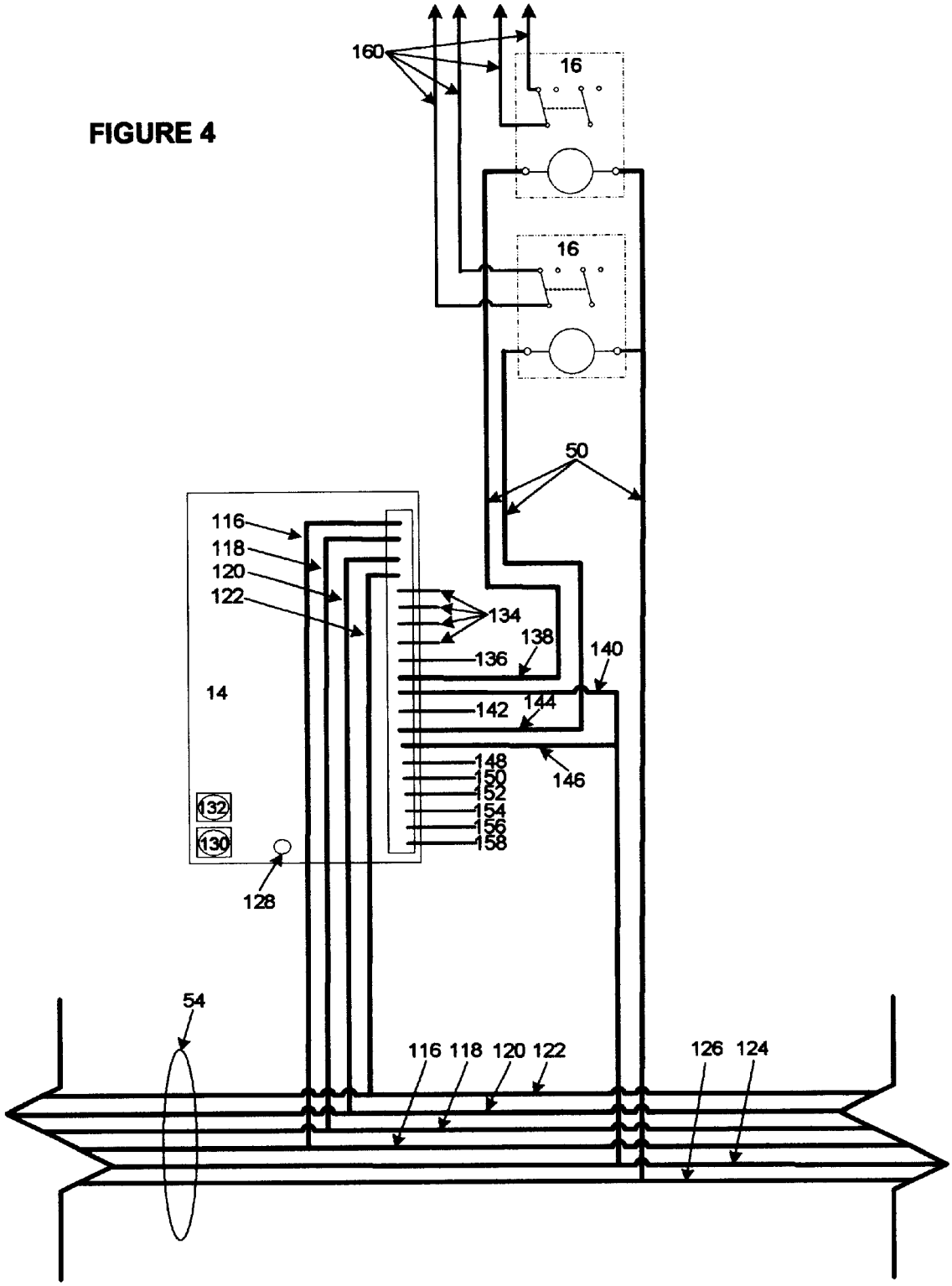
FIG. 4 is a drawing of a stand alone unit shut down circuit.

The addressable relay module 14 is further connected by a control circuit 50 to at least one burden relay DPDT 24 V DC coil 16, shown in FIGS. 1, 2 and 4 of the drawings, forming a stand alone unit shut down circuit, integrating with the data power cable 54. The addressable relay module 14 includes a data LED 128 indicating data being received by the addressable relay module 14, a relay address switch (ones) 130 and a relay address switch (tens) 132, a plurality of unconnected switched ground outputs 134, an unconnected first normally closed relay contact 136, a first common relay contact 138 connected to the coil 16, a first normally open relay contact 140 connected to the data power cable 54, an unconnected second normally closed relay contact 142, a second common relay contact 144, connected to another coil 16, a second normally open relay contact 146 connected to the data power cable 54, and a third normally closed relay contact 148, third common relay contact 150, third normally open relay contact 152, fourth normally closed relay contact 154, fourth common relay contact 156 and fourth normally open relay contact 158, allowing for the expansion of the addressable relay module 14 for operation of up to four total coils 16 and stand alone compressors. Each coil 16 attached to the addressable relay module 14 is further connected to the low voltage control circuit of the stand alone compressors, as further shown in FIG. 4, by low voltage control circuit wires 160.

FIGS. 5*a*, 5*b* and 6*a*, 6*b* of the drawings demonstrate the sensor mountings for use of two particular sensors, FIGS. 5*a* and 5*b* showing the mounting for a MANNING® IR-R (MANNING) sensor and FIG. 6*a* and 6*b*, showing the mounting for a NOVAR® RGM (NOVAR) sensor, both identified generically as a sensor 4.

In FIGS. 5*a* and 5*b*, the MANNING sensor 4 is installed with in the walk-in refrigeration unit 400. A liquid tight conduit 170, in compliance with NEC, is connected to the sensor 4, and a liquid tight connector 176, connects the liquid tight conduit to a first EMT conduit 168, which attaches to the inside horn and strobe unit 6. The inside horn and strobe unit 6 connects through the wall of the walk-in refrigeration unit 400 via a seal 172 and conduit nipple 174 to the outside horn and strobe unit 8. A second EMT conduit 166 further connects the inside horn and strobe unit 6 through the ceiling of the walk-in refrigeration unit 400 to a junction box 42 containing the addressable horn control module 10 and the addressable strobe control module 12, which are further connected to the VNTC tray cable 54 and also to a sensor power and data cable 52 contained by EMT conduit 164, thus routed to the control panel 2. FIG. 5*a* is a side view of the MANNING embodiment, while FIG. 5*b* is a front view of the MANNING embodiment. The signal from the MANNING sensor 4 to the control panel 2 is a 4–20 mA signal proportional to the level of refrigerant gas detected within the walk-in refrigerator unit 400. The refrigeration compressor controller input module 24, contained within the control panel 2 are programmed for this sensor signal. The MANNING sensor 4, inside and outside horn strobes 6, 8 are to be installed and mounted as shown in FIGS. 5*a* and 5*b* of the drawings and according to manufacturer's specifications, as well as being field calibrated per manufacturer's instructions during initial installation and then at recommended intervals also per manufacturer's recommendations.

In FIGS. 6*a* and 6*b*, the NOVAR system is different than the MANNING system because the NOVAR sensor 186 does not mount within the walk-in refrigeration unit 400. Instead, this embodiment has a length of plastic tubing 190, which penetrates the wall of the walk-in refrigeration unit 400 near the floor, the tubing being sealed within the wall by a seal 172. The tubing attaches to an adapter 182 and an in-line filter 184, which is further connected by plastic tubing 180 to a rubber cord grip 192 connected from below to the outside horn and strobe unit 8. The inside horn and strobe 6 connects through the wall of the walk-in refrigeration unit 400 via a seal 172 and conduit nipple 174 to the outside horn and strobe unit 8. An EMT conduit 168 then attaches the outside horn and strobe unit 8 to the junction box 42, containing the addressable horn control module 10 and the addressable strobe control module 12 and a coiled length of excess plastic tubing 182 through a coupling 194 attached to the NOVAR sensor 186, or generically, the sensor 4. From the junction box 42, data is then sent and received via the sensor power and data cable 52 and the VNTC tray cable 54 contained in the EMT conduit 164 to the control panel 2.

In FIGS. 7*a* and 7*b*, a front and side view of the NOVAR sensor 186 is shown in a larger scale than in FIGS. 6*a* and 6*b*. As seen in FIG. 7*a*, the plastic tubing 180 enters the junction box 42 through the EMT conduit 168, forms the coil of plastic tubing 182 around the addressable horn control module 10 and the addressable strobe control module 12, and exits the junction box 42 through the coupling 194 to the NOVAR sensor 186. Data from the NOVAR sensor 186 is then sent through the junction box 42 through the EMT conduit 164 to the control panel 2. The signal from the NOVAR sensor 186 to the control panel 2 is a 1–5 V DC signal proportional to the level of refrigerant gas detected within the respective walk-in refrigeration unit 400. The refrigerant compressor controller input modules 24, contained within the control panel 2 are programmed for this sensor signal. The NOVAR sensor, 186 and inside and outside horn and strobe units are to be installed as shown in FIGS. 6*a*–7*b* of the drawings and per manufacturer's recommendations. NOVAR sensors 186 do not require field calibration during initial installation, but do require calibration at regular intervals as per manufacturer's recommendations.

The system may be designed and should be provided for large or small operations, with expansion potential to operate multiple walk-in refrigeration units at a single facility. In both systems, the large operation shown in FIG. 8 and the smaller operation shown in FIG. 9, the control panel 2 includes multiple terminal strips provided for this expansion capability to receive multiple line connections as an input and communication terminal block 202, a power and control terminal block 204 containing a plurality of power input and system fuses 196, a plurality of reset and tamper relays 198, and at least one 1K ½ W end of line resistors 200, a data and control terminal block 206, and a transformer terminal block 208, these terminal blocks indicated in FIGS. 8–9 of the drawings in relation to the system, said terminal blocks 202, 204, 206, 208 all placed within the control panel 2. In addition, additional terminal blocks for 120V power indicators and door data and control may also be placed within the control panel 2. An output module transformer 214, a module power supply transformer 216 and an FACP transformer 218 are also placed within the control panel 2, or at least within the immediate proximity of the control panel 2.

In the event a large operation is required, with multiple refrigeration units, the addition of multiple inside walk-in horn and strobe units 6, multiple outside walk-in horn and strobe units 8, multiple remote refrigerant leak sensors 4, multiple first and second addressable horn and strobe control modules 10, 12 and other elements to monitor multiple refrigeration units at a single location are provided for.

It is anticipated that other version using different specified components may be assembled and configured to serve the same monitoring function as disclosed in this refrigerant leak detection system. Those specified components are those found to be the best mode of operation of this leak detection system, but are not intended to limit the scope of the invention to a single specified part or component. Therefore, size, shape, amperage, wattage or voltage is defined as that which will serve to conduct the overall function of the leak detection system. In addition, reference to any specific component by name or trademark is merely reference to those specific components used in the making and construction of the leak detection system, which is also not intended to restrict the leak detection system to those certain named components, nor is it an endorsement of those particular products over another.

In general, the system operates as follows varying by the level of refrigerant gas detected in the particular walk-in refrigerated unit 400 it monitors, whether one or several. When the level of refrigerant gas detected is below 1000 ppm, there is no action taken by the system. The warning signal is transmitted by said refrigerant leak sensor 4 to the control panel 2 when the leak sensor 4 detects between 1000 and 2999 ppm of refrigerant gas within the affected walk-in refrigeration unit 400, causing the strobe only of the inside and outside horn and strobe units 6, 8, to activate, also registering the warning in the fire alarm control panel first FACP keypad 20 located in the front of the control panel 2 and the second remote FACP keypad 18 at the remote monitoring point until the control panel 2 is reset or reactivated and until the affected walk-in refrigeration unit 400 is repaired and the concentration of the refrigerated gas within the affected walk-in refrigeration unit 400 is brought below 1000 ppm threshold.

When a detected level of refrigerant gas is to 3000 ppm or above, an alarm signal is transmitted from the refrigerant leak sensor 4 in the affected walk-in refrigeration unit 400 to the control panel 2, causing the inside and outside horn and strobe units for the affected walk-in refrigeration unit 400 to activate, also registering the alarm in the fire alarm control panel first FACP keypad 20 located in the front of the control panel 2 and the second remote FACP keypad 18 at the remote monitoring point until the control panel is reset or reactivated and until the affected walk-in refrigeration unit 400 is repaired and the concentration of the refrigerated gas within the affected walk-in refrigeration unit 400 is brought below 1000 ppm threshold.

Responses of the system react to the above system operation also includes the following. While the refrigerant leak levels are detected below 1000 ppm, the FACP keypads 18, 20, indicate current time and date along with a default message showing system location and refrigerant type. A keypad button backlight is green or neutral in color. All horn and strobe units 6, 8 are off and no control signals are sent to the evaporator solenoid valves 320.

When a detected leak level above 1000 ppm but below 3000 ppm is sensed, the system initiates the warning signal. The strobes of the horn and strobe units 6, 8 are activated in the affected area and a warning signal is transmitted to the control panel 2 remote monitoring point. The keypads 18, 20 replace the time, date and default message with a warning alarm message that indicates the leak area by zone designation and name. The keypads 18, 20, having an internal piezo sounder, activates the pieze sounder and the keypad button backlight turns red.

When a detection of a leak in excess of 3000 ppm is sensed, the alarm signal is initiated. The horns and strobes 6, 8 are activated in the affected area and the alarm signal is transmitted to the monitoring point. The evaporator solenoid valves 320 in the affected areas are closed. The keypads 18, 20 time, date and default messages are replaced with an alarm level message that indicates the leak area by zone designation and name. The piezo sounder is turned on and the keypad button backlight turns red.

System reset is accomplished by first making necessary repairs and ventilating the affected area to reduce the refrigerant levels below the warning threshold of 1000 ppm and them depressing the reset switch 34 located on the control panel 2 or initiating a remote reset through the refrigeration system controller 300. When the system is successfully reset, all horns and strobes 6, 8 will be deactivated and the keypads 18, 20 will return to the default message, the piezo sounder is deactivated and the keypad button backlight returns to its green or normal color.

If default occurs within the system or on any of the supervised circuits, a system fault is indicated at the monitoring point. The keypads 18, 20 will indicate the type of fault condition and the location of the area affected and the piezo sounder is activated. When the fault is corrected, the system will automatically return to the normal condition. All events are logged to a 100 event log. If the event log becomes full, new events are handled on a first in/first out basis.

While the invention has been particularly shown and described with reference to a preferred embodiment thereof, it will be understood by those skilled in the art that changes in form and detail may be made therein without departing from the spirit and scope of the invention.

What is claimed is:

1. A leak detection system to monitor, report and control at least one walk-in refrigeration unit having a flow of refrigerated gas, the leak detection system essentially comprising:

a refrigerant leak detection control panel, connected to;

at least one remote refrigerant leak sensor within or attached to the at least one walk-in refrigeration unit;

an uninterruptable power supply connected to and providing power to said control panel, at least one inside walk-in horn and strobe unit connected to said control panel through an addressable horn control module;

at least one outside walk-in horn and strobe unit connected to the control panel through an addressable strobe control module;

a horn and strobe power supply with battery backup connected to said at least one inside walk-in horn and strobe unit and said at least one outside walk-in horn and strobe unit;

an addressable fire alarm control panel within said control panel connecting to a power supply with battery backup, including a first FACP keypad located in the front of the control panel, and to a second remote FACP keypad;

said control panel further connected to the refrigeration compressor equipment room by a data power cable first through a zone expansion module and second, to an addressable relay module, integrating with a refrigeration compressor controller of the walk-in refrigeration unit, to an output module of the walk-in refrigeration unit;

said control panel, through a refrigeration compressor controller of the walk-in refrigeration unit, still further connecting to evaporator liquid and suction line solenoid valves controlling the flow of refrigerated gas to the walk-in refrigeration unit in the event a shutdown of said flow of refrigerated gas is warranted.

2. The system, as disclosed in claim 1, wherein:

no action is taken by said system if the refrigerant lead sensor detects a concentration of refrigerated gas within said walk-in refrigeration unit is below 1000 ppm;

a warning signal is transmitted by said refrigerant leak sensor to the control panel when said refrigerant leak sensor detects between 1000 and 2999 ppm of refrigerated gas within said walk-in refrigeration unit, causing said inside and outside horn and strobe units to activate, also registering said warning signal in said first FACP keypad and said second remote FACP keypad; and an alarm signal transmitted by said refrigerant leak sensor to said control panel, when said refrigerant leak sensor detects 3000 ppm or more within said walk-in refrigeration unit, causing said horn and strobe units to activate, until said control panel is reset or reactivated and until said walk-in refrigeration unit is repaired and the concentration of refrigerated gas within said walk-in refrigeration unit is brought back below the 1000 ppm threshold, said alarm signal also registering on said first FACP keypad and second remote FACP keypad.

3. The system, as disclosed in claim 1, wherein said control panel further comprises:

the addressable fire alarm control panel connected by a data power cable to a first FACP keypad annunciator located in the front of the control panel; and to a second FACP keypad annunciator located remotely;

at least one FACP zone expansion module connected to at least one output module, to at least on input module and ultimately to at least one said refrigerant leak sensor;

a tamper strobe activate by unauthorized access to said control panel;

a system reset switch to reset said control panel after response;

a power indicator indicating power to said control panel;

an addressable module power supply with battery backup located within or near said control panel attached to said at least one addressable horn and strobe control modules, a horn and strobe power supply with battery backup attached to said inside and outside horn and strobe units, a sensor and system power supply located within said control panel supplying power supply to said at least one refrigerant leak sensor; and a plurality of input and output module communications cables extending from said control panel for remote monitoring of said leak detection system.

4. The system, as disclosed in claim 1, wherein the sensor is a MANNING® IR-R sensor.

5. The system as disclosed in claim 1, wherein the sensor is a NOVAR® RGM sensor.

6. A leak detection system to monitor, report and control a plurality of walk-in refrigeration units having a flow of refrigerated gas at a single location, the leak detection system essentially comprising:

a refrigerant leak detection control panel, connected to;

a plurality of remote refrigerant leak sensors within or attached to the plurality of walk-in refrigeration units at a single location;

an uninterruptable power supply connected to and providing power to said control panel, a plurality of inside walk-in horns and strobes, one for each of said walk-in refrigeration units, connected to said control panel through an addressable horn control module per each of said plurality of inside walk-in horns and strobes;

a plurality of outside walk-in horns and strobes, one for each of said walk-in refrigeration units, connected to said control panel through an addressable horn control module per each of said plurality of outside walk-in horns and strobes;

a horn and strobe power supply with battery backup connected to each of said inside walk-in horns and strobes and each of said outside walk-in horns and strobes; and an addressable fire alarm control panel within said control panel connecting to a power supply with battery backup including a first FACP keypad located in the front of the control panel, and to a second remote FACP keypad; and said control panel further connected to the refrigeration compressor equipment room by a data power cable first through a zone expansion module and second, to an addressable relay module, integrating with a refrigeration compressor controller of each of said walk-in refrigeration units, to an output module of each of said walk-in refrigeration units; and said control panel still further connecting to evaporator liquid and suction line solenoid valves controlling the flow of refrigerated gas to each of said walk-in refrigeration units in the event a shutdown of said flow of refrigerated gas is warranted in each of said walk-in refrigeration units.

7. The system as disclosed in claim 6, wherein said control panel comprises:

multiple plug terminal strips provided for expansion capability to receive multiple line connections from each of said plurality of walk-in refrigeration units, each said terminal strip having an input and communication terminal block, a power and control terminal block containing a plurality of power input and system fuses, a plurality of reset and tamper relays, at least one 1K ½ W end of line resistors, a data and control terminal block, and a transformer terminal block, said input and communication terminal block, power and control terminal block, data and control terminal block and transformer terminal block all placed within said control panel; and an output module transformer, a module power supply transformer and an FACP transformer also placed within or near said control panel.

8. The system, as disclosed in claim 6, wherein:

no action is taken by said system if none of the plurality of refrigerant lead sensors detects a concentration of refrigerated gas within any of the plurality of said walk-in refrigeration units is below 1000 ppm;

a warning signal is transmitted from one or more of said plurality of refrigerant leak sensors to the control panel when one or more of said refrigerant leak sensor detects between 1000 and 3000 ppm of refrigerated gas within an affected walk-in refrigeration unit containing the detected level of refrigerated gas, causing the inside and outside horn and strobe units to activate on said affected walk-in refrigeration unit, also registering said warning signal in said first FACP keypad and said second remote FACP keypad; and an alarm signal transmitted from one or more of said plurality of refrigerant leak sensors to said control panel when one or more of said refrigerant leak sensors detects 3000 ppm or more within an affected walk-in refrigeration unit containing the detected level of refrigerated gas, causing said horn and strobe unit to activate on said affected walk-in refrigeration unit, said control panel sending a response signal to close off said flow of refrigerated gas to said affected walk-in refrigeration unit, capturing any remaining refrigerated gas in the refrigeration compressor controller to said affected walk-in refrigeration unit until said control panel is reset or reactivated and until said affected walk-in refrigeration unit is repaired and the concentration of refrigerated gas within said affected walk-in refrigeration unit is brought back below the 1000 ppm threshold, said alarm signal also registering on said first FACP keypad and said second remote FACP keypad.

9. The system, as disclosed in claim 6, wherein said control panel further comprises:

the addressable fire alarm control panel connected by a data power cable to a first FACP keypad annunciator located in the front of the control panel; and to a second FACP keypad annunciator located remotely;

each said refrigerant leak sensor connected to an FACP zone expansion module by an input module and an output module;

a tamper strobe activate by unauthorized access to said control panel;

a system reset switch to reset said control panel after response;

a power indicator indicating power to said control panel;

an addressable module power supply with battery backup located within or near said control panel attached to each of said addressable horn and strobe control modules, a horn and strobe power supply with battery backup attached to each said inside and outside horns and strobes, a sensor and system power supply located within said control panel supplying power supply to each of said refrigerant leak sensors; and a plurality of input and output module communications cables extending from said control panel for remote monitoring of said leak detection system.

10. The system, as disclosed in claim 6, wherein each said sensor is a MANNING® IR-R sensor.

11. The system as disclosed in claim 6, wherein each said sensor is a NOVAR® RGM sensor.

* * * * *